US007014189B2

(12) United States Patent
Liu et al.

(10) Patent No.: US 7,014,189 B2
(45) Date of Patent: Mar. 21, 2006

(54) ALIGNMENT DISK FOR DOCUMENT VALIDATOR

(75) Inventors: Donald Pakman Liu, Las Vegas, NV (US); Raymond Waiman Lui, Las Vegas, NV (US)

(73) Assignee: Valtech International, LLC, Las Vegas, NV (US)

( * ) Notice: Subject to any disclaimer, the term of this patent is extended or adjusted under 35 U.S.C. 154(b) by 172 days.

(21) Appl. No.: 10/774,673

(22) Filed: Feb. 9, 2004

(65) Prior Publication Data

US 2004/0211839 A1 Oct. 28, 2004

Related U.S. Application Data

(60) Provisional application No. 60/457,153, filed on Mar. 24, 2003.

(51) Int. Cl.
*B65H 9/04* (2006.01)
*B65H 9/16* (2006.01)

(52) U.S. Cl. ..... 271/248; 271/245

(58) Field of Classification Search ..... 271/248, 271/226, 229, 230, 234, 245
See application file for complete search history.

(56) References Cited

U.S. PATENT DOCUMENTS 4,728,096 A 3/1988 Winkler et al.
4,953,846 A * 9/1990 Azeta et al. ..... 271/251
5,031,895 A * 7/1991 Couper ..... 271/251
5,527,031 A 6/1996 Walsh et al.
5,540,423 A * 7/1996 Nakano ..... 271/10.12
5,662,201 A 9/1997 Gerlier et al.
5,678,678 A 10/1997 Brandt, Jr. et al.
5,740,897 A 4/1998 Gauselmann
5,996,314 A 12/1999 Pennini et al.
6,019,207 A 2/2000 Cole
6,053,299 A 4/2000 Rollins
6,125,988 A 10/2000 Waters
6,398,000 B1 6/2002 Jenrick et al.
6,493,461 B1 12/2002 Mennie et al.
6,619,658 B1 * 9/2003 Shiau ..... 271/274

FOREIGN PATENT DOCUMENTS

WO WO 03/034355 A1 4/2003

* cited by examiner

*Primary Examiner*—Donald P. Walsh
*Assistant Examiner*—Mark J. Beauchaine
(74) *Attorney, Agent, or Firm*—Welsh & Katz, Ltd.

(57) ABSTRACT

An apparatus is provided for processing a document traveling along a document path within a document validator. The such apparatus includes a disk where a periphery of the disk extends into the document path of the document validator, a support shaft that passes through a center hole of the disk, the shaft loosely supporting the disk and allowing the disk to rotate around the shaft in a predominant plane of the disk and to freely move in the predominant plane of the disk in a direction that is perpendicular to a longitudinal axis of the shaft and a resilient member that biases the disk into the document path to engage a side edge of the document when the document is misaligned with the document path as it travels along the document path thereby retarding forward movement of the side edge and rotation of the document into alignment with the document path.

21 Claims, 14 Drawing Sheets

6a
6b

UPPER HEAD ASSEMBLY
VA-PCBA01-XX
MAIN BOARD
VA-PCBA03-XX
UPPER SENSOR
BOARD
PC-LINK
PHONO JACK
M1
C
CN9
O.S.W.
AMP 16-PIN
CN5
INTERFACE PLUG-IN
OPTIONAL
CN1
MAG
SWITCH
114
LATCH
TMR
VA-PCBA02-XX
MAGNETIC BOARD
OPTIONAL
BATT
+
−
CN3
VA-PCBA08-XX
TACHOMETER
CN7
FLASH EPROM
VA-WIRA02-XX
104
VA-WIRA08-XX
106
CN8
DRIVE MOTOR
CN1
TD
PP
CPU
VA-WIRA03-XX
102
LIB
STACKER MOTOR
CN2
WP
108
VA-WIRA04-XX
112
110

100

LOWER HEAD ASSEMBLY
52
IR / BLUE
52
IR / BLUE
56
SUPER
RED/BLUE
78
IR / SENSOR
VA-PCBA06-XX
LOWER SENSOR
BOARD
52
M
VA-PCBA06-XX
DIAGNOSTIC BOARD
CN2
CN3
VA-WIRA07-XX
VA-PCBA06-XX
UV SENSOR BOARD
OPTIONAL
VA-WIRA01-XX
26
UV
SD
CN1
28
PD
29

ALIGNMENT DISK FOR DOCUMENT VALIDATOR

FIELD OF THE INVENTION

The field of the invention relates to document recognition and more particularly to currency validators.

BACKGROUND OF THE INVENTION

Currency validators are generally known. Such devices are typically used on such devices as vending machines or slot machines to accept a limited scope or type of bill of a particular currency or coupons or bar codes.

Currency validators typically function by measuring an amplitude of light reflection at one or more positions of the bill and comparing the measured color with a predetermined value. If the measured value falls within a range of the predetermined value, then the bill is accepted as genuine. If the measured value exceeds the predetermined value, then the bill is rejected.

Other currency validators rely upon fluorescence. Currency validators of this type are typically hand-operated devices that detect the use of specially formulated fluorescent inks used by some countries in the printing of their currency.

In the case of currency validation based upon florescence, an ultraviolet light is directed at the bill and a level of fluorescence is measured. If the level of fluorescence is below a predetermined value then the bill is accepted.

Other currency validators may rely upon a combination of color measurement and fluorescence. While such systems are relatively effective, they lack the flexibility to cope with currency that has been defaced or is in poor condition. Accordingly, a need exists for a currency validator that is able to recognize and reliably accept a wide variety of currencies and currency conditions.

SUMMARY

Figure 1A:
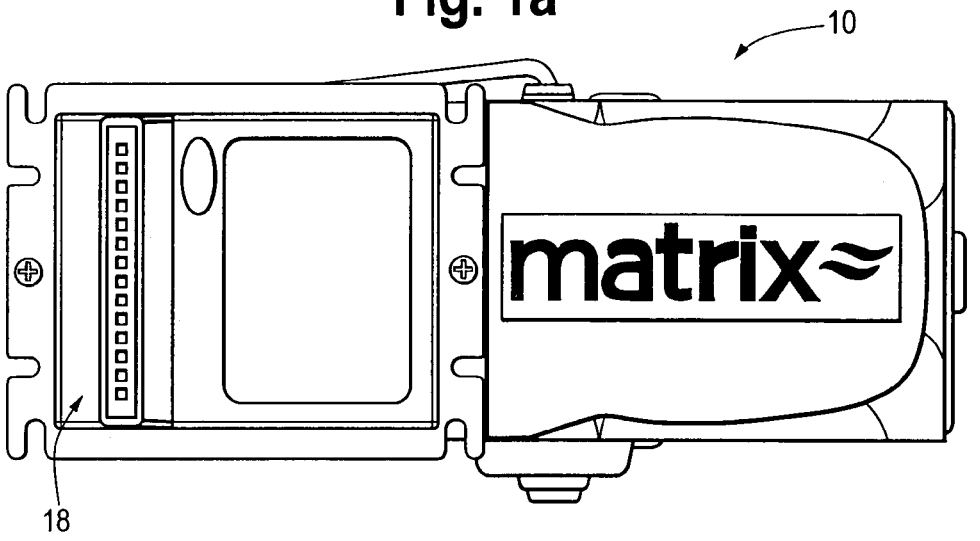
FIGS. 1*a–b* are top and side views of a document validator in accordance with an illustrated embodiment of the invention.

A method and apparatus are provided for authenticating a document. The method includes the steps of measuring a plurality of metrics of a suspect document and arranging the metrics into a plurality of data profiles. The method further includes the steps of comparing the plurality of data profiles with a set of envelopes of a library document and determining that the document is authentic when the plurality of profiles conforms with the plurality of envelopes or are within a predetermined error margin.

An apparatus is also provided for processing a document traveling along a document path within a document validator. The such apparatus includes a disk where a periphery of the disk extends into the document path of the document validator, a support shaft that passes through a center hole of the disk, the shaft loosely supporting the disk and allowing the disk to rotate around the shaft in a predominant plane of the disk and to freely move in the predominant plane of the disk in a direction that is perpendicular to a longitudinal axis of the shaft and a resilient member that biases the disk into the document path to engage a side edge of the document when the document is misaligned with the document path as it travels along the document path thereby retarding forward movement of the side edge and rotation of the document into alignment with the document path.

As used herein, measuring a metric of a suspect document means measuring a characteristic of the medium of the document. It does not mean measuring a width or thickness of the document. Further, measuring a characteristic of the medium of the document means measuring a characteristic of the substrate of the document or any substance printed thereon or any stamp, window or sticker permanently attached to the document.

Under one illustrated embodiment, the measured metric may be the reflected and transmissive qualities of the medium of the suspect document in response to an impinging infrared (IR), super red or blue optical signal. Under another illustrated embodiment of the invention, the measured metric may be the fluorescent signal emitted by the medium in response to an impinging ultraviolet (UV) signal. Under still another illustrated embodiment of the invention, the measured metric may be a magnetic level of the medium.

The measured metrics may be arranged into data profiles and compared with a corresponding set of envelopes of a library document to determine whether the suspect document is authentic. The envelopes may define upper and lower limits for the measured metrics of the suspect document. The determination of authenticity (also sometimes referred to herein as validating the document) may be based upon a comparison of the data profiles with a set of envelopes that define the library document and upon conformance of the data profiles with the set of envelopes. Conformance, in this case, means that the data profiles substantially lie between the upper and lower limits of the envelopes that define the library document.

The arrangement of the measured metrics into the data profiles may be based upon any method by which the distinctive features of a document may be captured. For example, under one embodiment the data profiles may be formed from data collected by signal format (e.g., magnetism of the medium, fluorescence of the medium, optical signal color and whether it is a reflected signal or a signal transmitted through the suspect document, etc.) and by position along a predetermined path across the document.

DETAILED DESCRIPTION OF AN ILLUSTRATED EMBODIMENT

The validator can be described as a system that identifies valid documents (e.g., currency) and functions to authorize some activity based upon the validation. For example, the validator may be used in a vending machine to accept currency and authorize the dispensing of food from the vending machine. As used herein, validation means determining that a document is authentic.

Figure 1B:
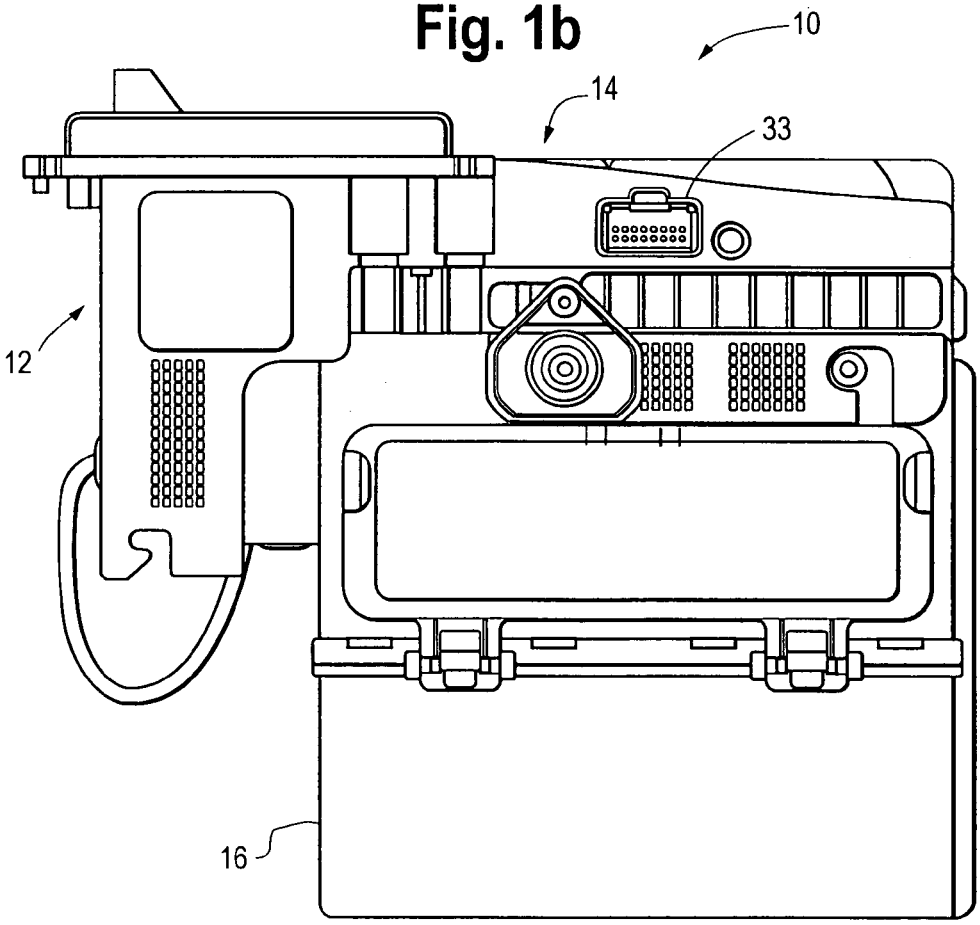

FIG. 1 depicts top and side views of a validator 10, shown generally in accordance with an illustrated embodiment of the invention. The validator 10 includes a sensor section 12, a transport system section 14 and a document cassette 16. Documents may be fed into an entrance slot 18 where it is detected by a set of IR sensors 78*a,b*. Detection by the IR sensors 78*a,b* activates the transport system.

Figures 6, 6A:
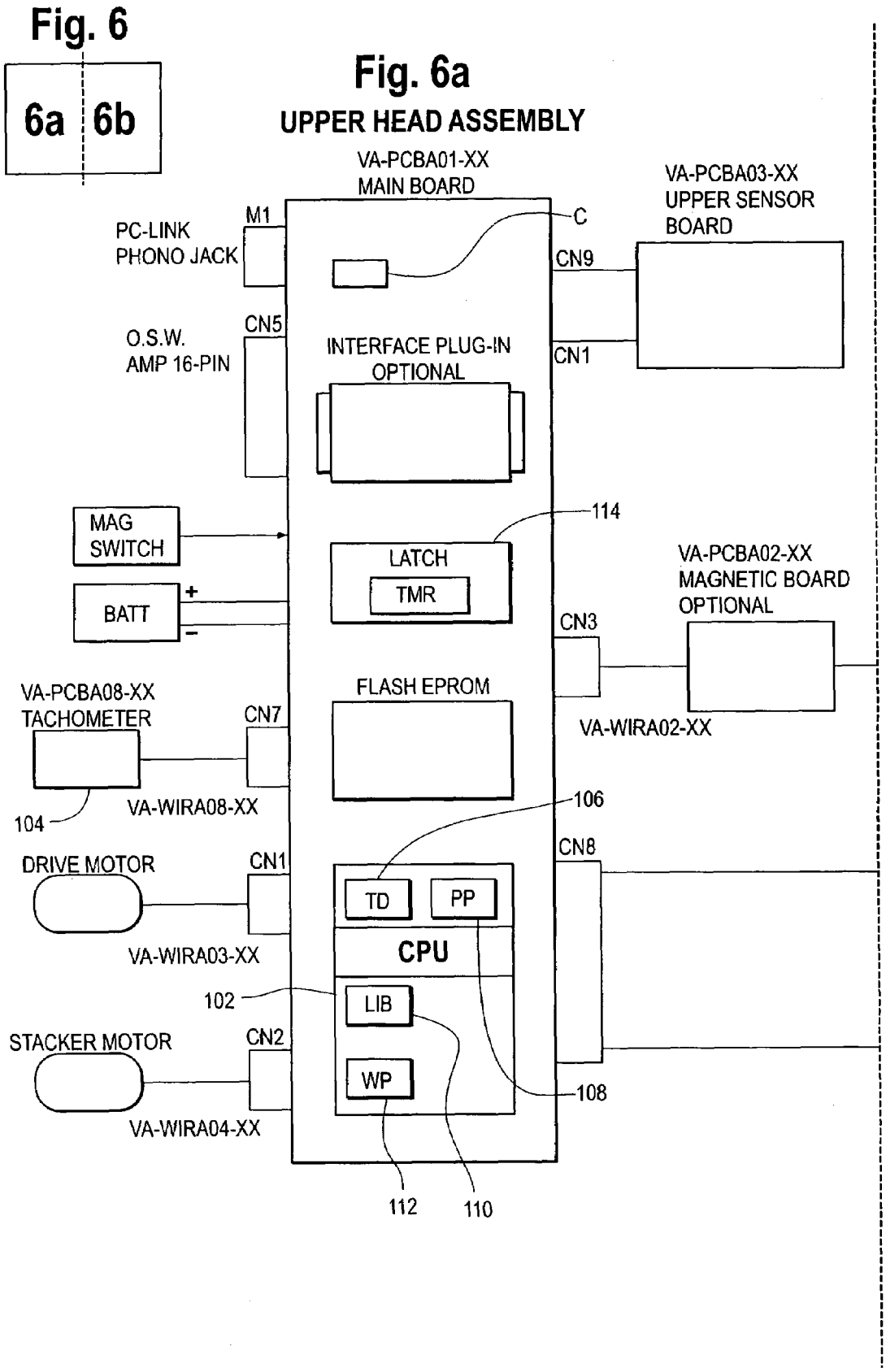
FIG. 6 depicts a control system that may be used by the system of FIG. 1.
Figure 6B:
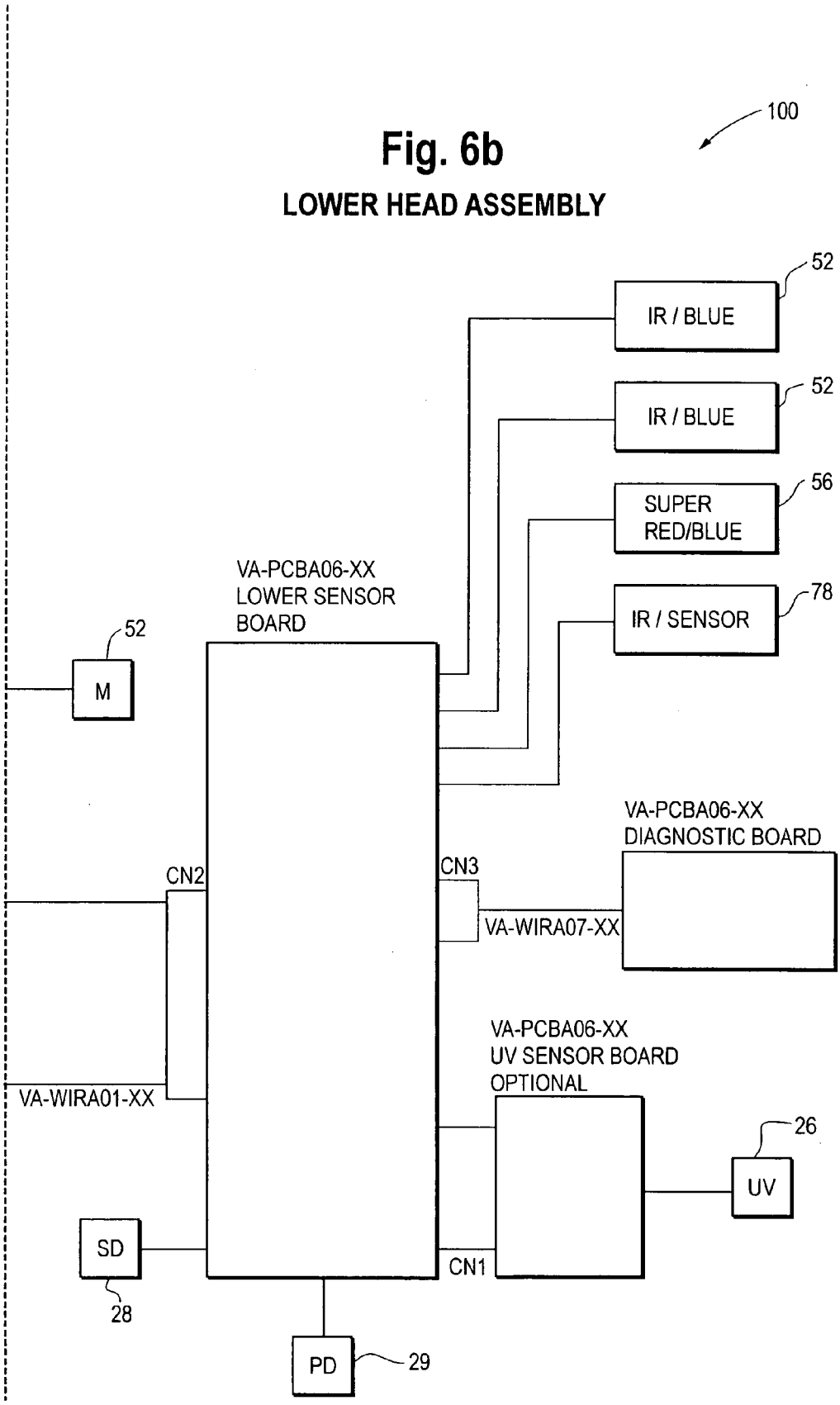
Figure 11:
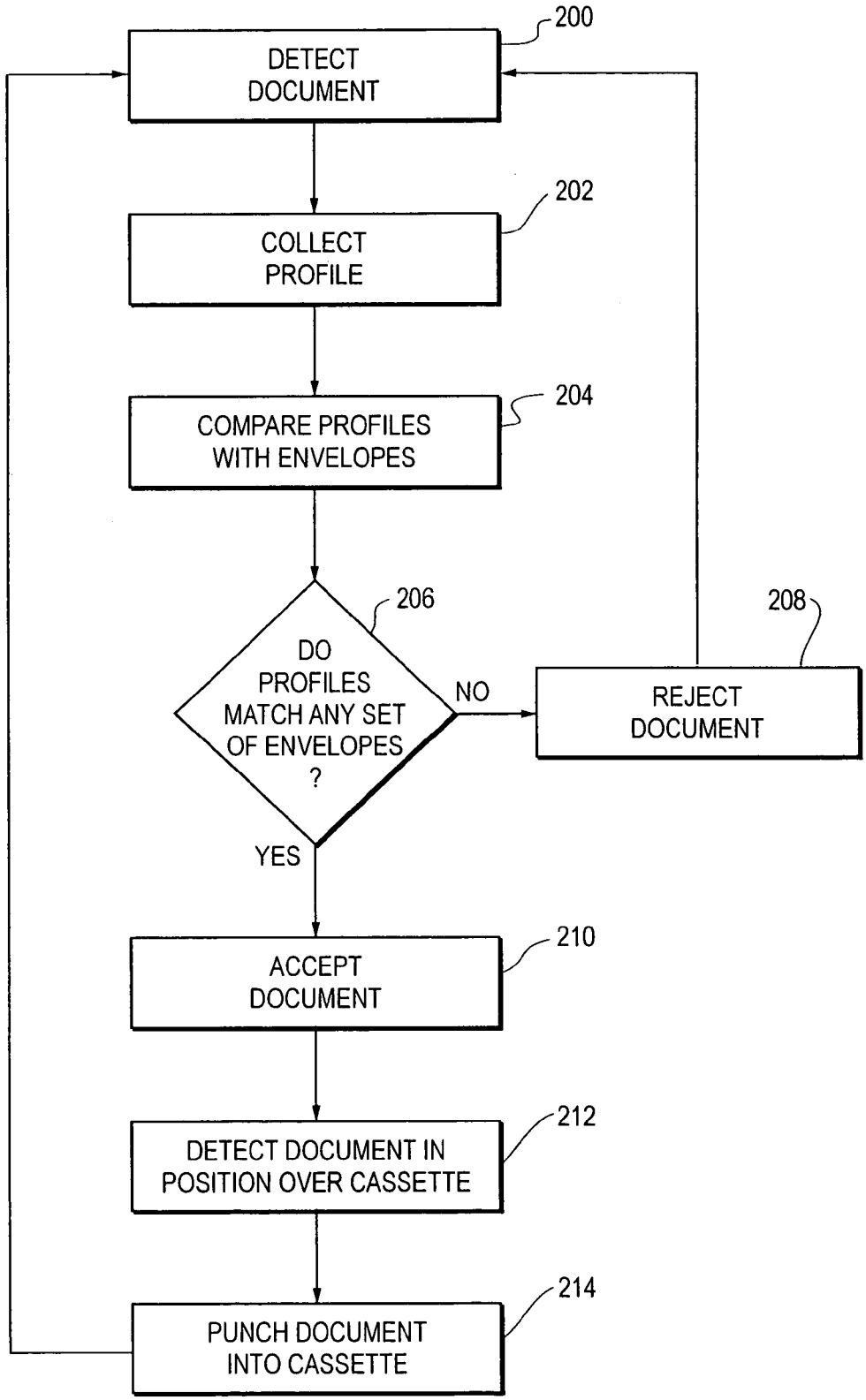
FIG. 11 is a flow chart of the method steps that may be used by the validator of FIG. 1.

FIG. 11 is a flow chart that depicts steps that may be followed by the validator 10 in determining the authenticity of a document. Reference may be made to FIG. 6 as appropriate to an understanding of the invention.

Figure 2:
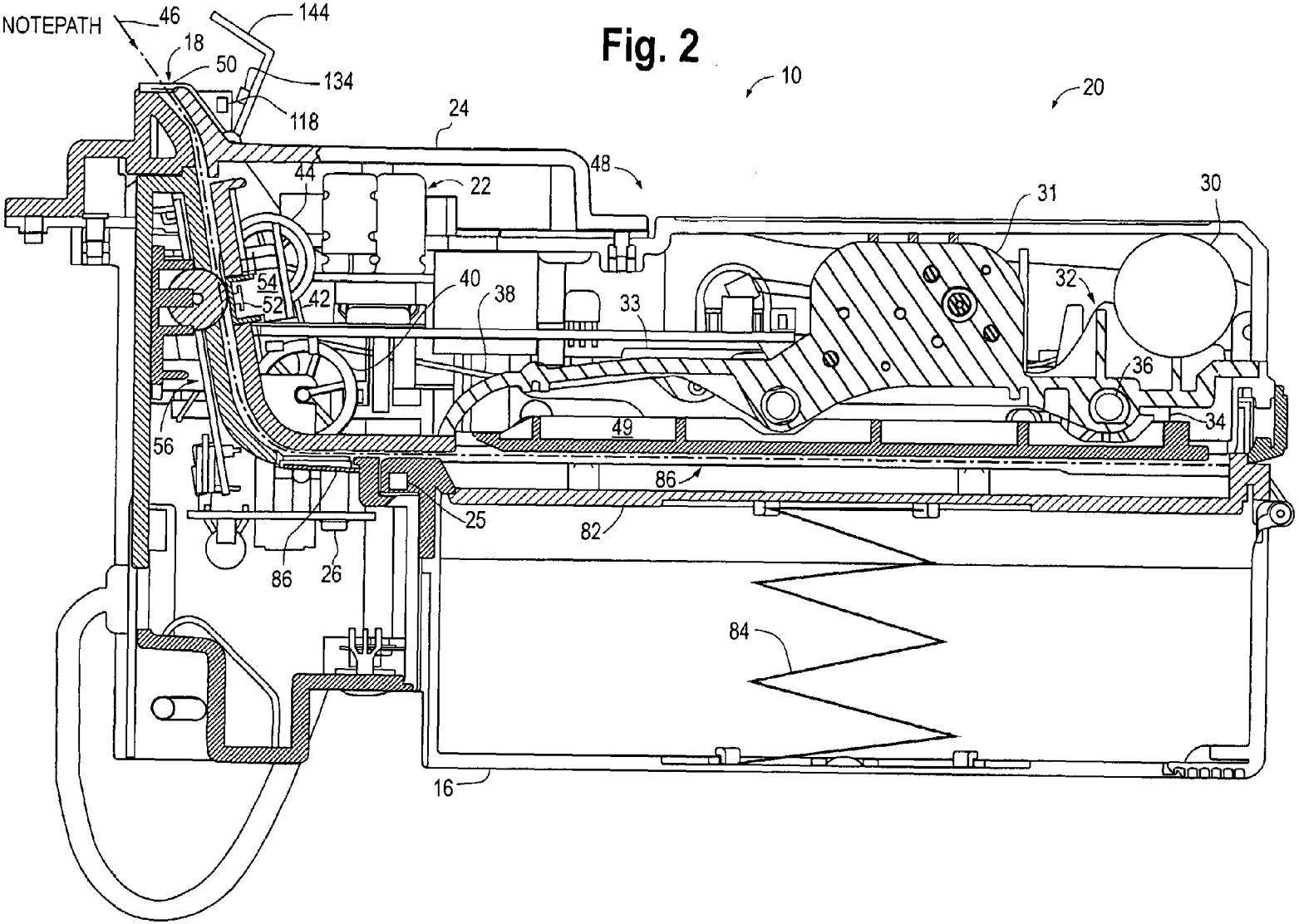
FIG. 2 is a cut-away view of the validator of FIG. 1.

FIG. 2 shows a cut-away side view of the validator 10. The transport section 14 contains a drive system 20 that moves a document through the validator. The drive system 20 generally includes a drive motor 30 that is directly coupled to a gear train 32. An output of the gear train 32 is directly coupled to a pair of head-end drive pulleys 34 mounted on a common shaft 36. A pair of continuous belts 38, equidistant from a centerline of a path of travel 50 of the document 46 and separated by a distance of at least 34 mm, pass over the head-end pulleys 34 and a set of tail-end pulleys 40. A secondary pair of belts 42, driven by the tail-end pulleys 40 drives a pair of initial drive capstans 44. The drive system functions to transport a document 46 inserted into the slot 18 through the validator 10 along the note path 50.

The transport system 20 moves the document 46 past a number of arrays of sensors within the sensor section 12. The sensors function to detect 100 the presence of a document 46 as well as provide information sufficient to identify a type of document and to establish whether the document is authentic. Once the type of document has been identified and accepted as authentic, the transport system moves the document to an area adjacent a cassette 16. A stacking system 48 functions to stack the document into the cassette.

The arrays of sensors may include a set of profiling sensor arrays, anti-stringing sensors, an ultraviolet (UV) sensor and a timing and position sensor. The profiling sensors include a magnetic sensor 54 that is centrally located adjacent a flat side of the document path 50 and a set of spaced-apart IR/blue sensor arrays 52 located on either side of the magnetic sensor 54 (one sensor array 52 shown in phantom in FIG. 2). Following the IR/blue sensors 52 is a centrally-located super red/blue sensor array 56. (As used herein, a super red optical signal is a visible optical signal adjacent the infrared spectrum). As each document passes through the profiling section of the validator 10, a profile of the document 46 is collected 202 along the length of the document 46 based upon position by each sensor array. A profile of the document is a succession of readings of the same signal type along some predetermined path across a portion of the document.

Figure 3:
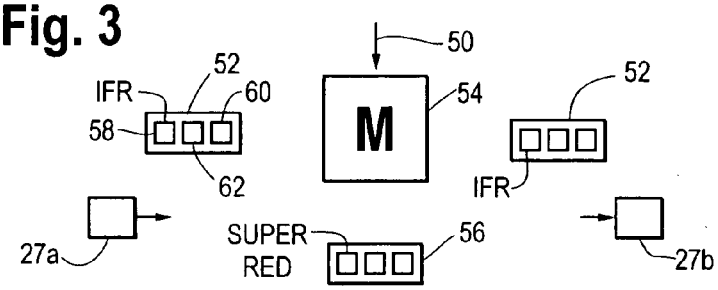
FIG. 3 is a plan view of the sensor arrays of the validator of FIG. 1.
Figure 4:
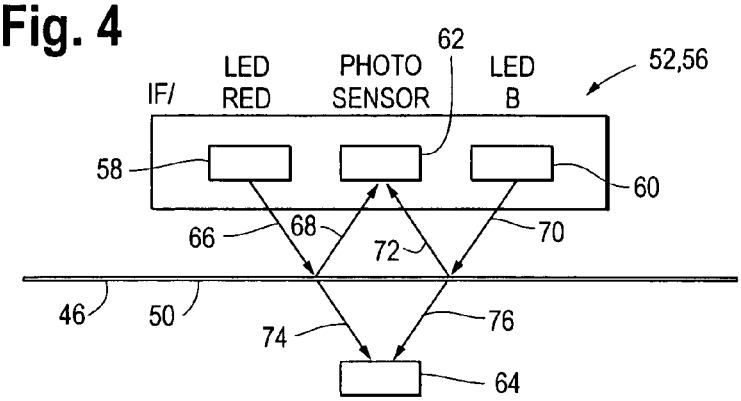
FIG. 4 depicts optical transmission paths of the sensor arrays of FIG. 3.

FIG. 3 shows a plan view of the sensor 52, 54, 56. FIG. 4 shows a functional view of a IR/LED sensor array 52 in terms of optical transmission and detection.

Figure 7:
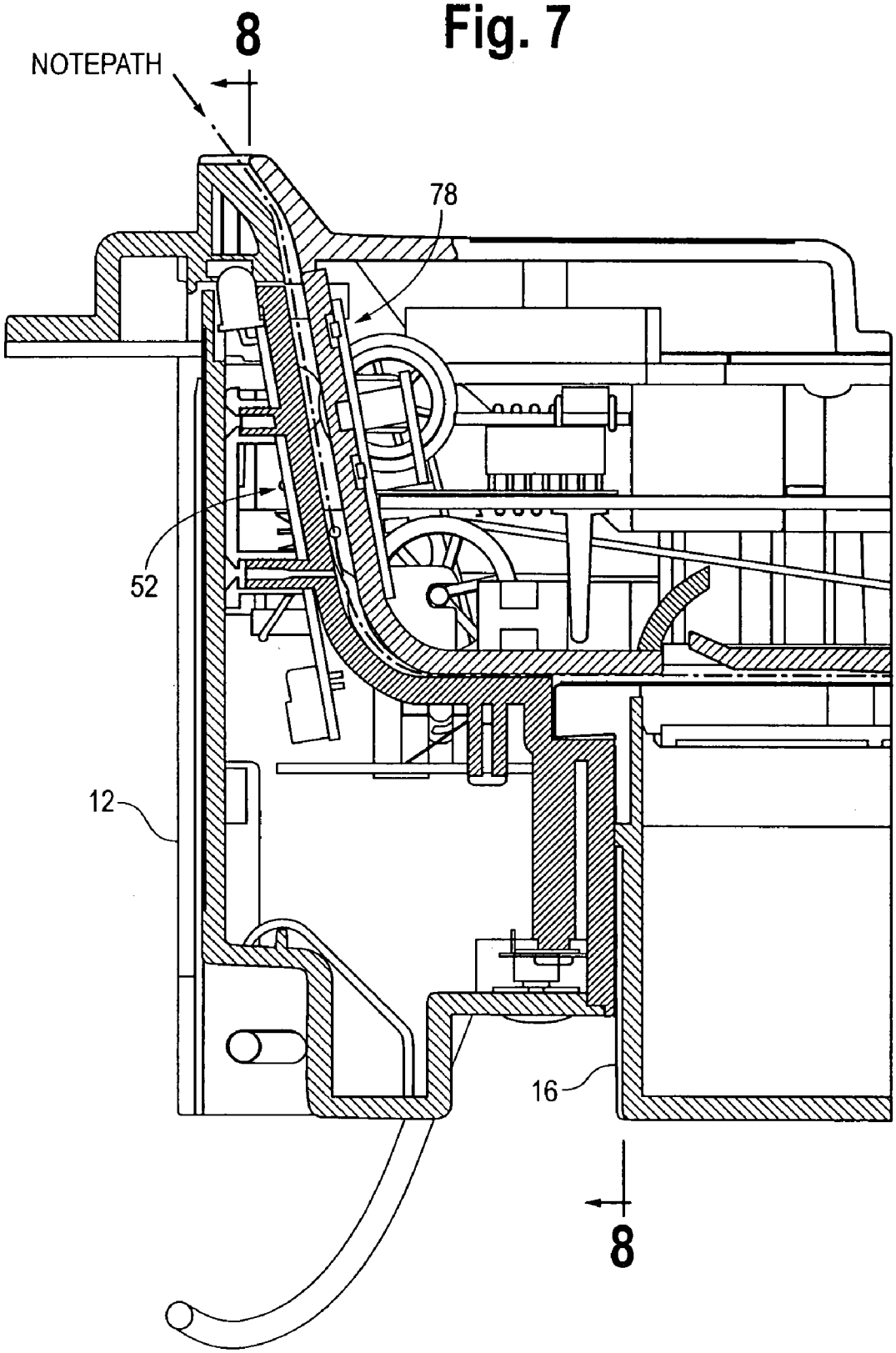
FIG. 7 shows a simplified cut-away view of FIG. 2.
Figure 8:
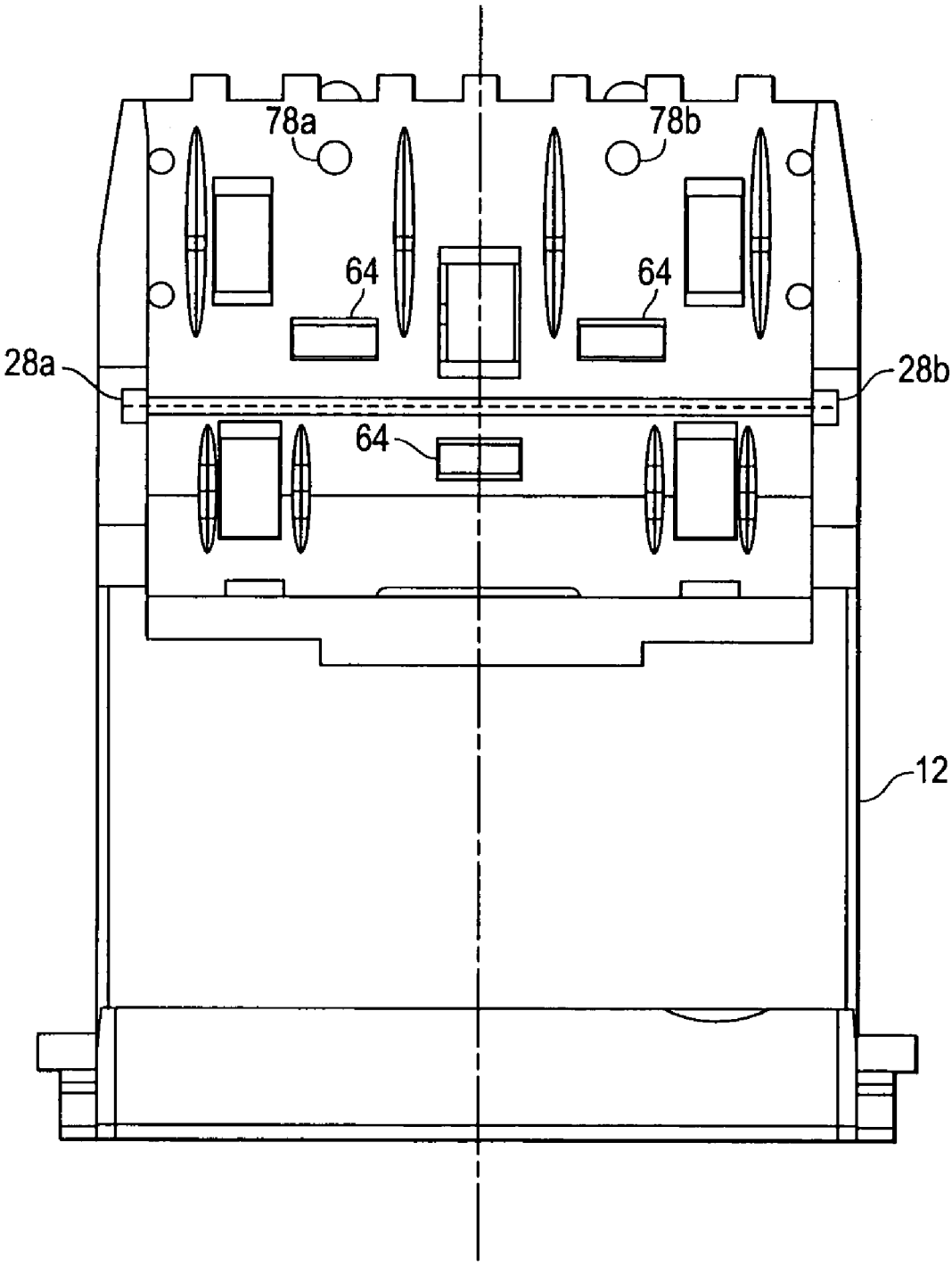
FIG. 8 shows a section view of FIG. 7.
Figure 9:
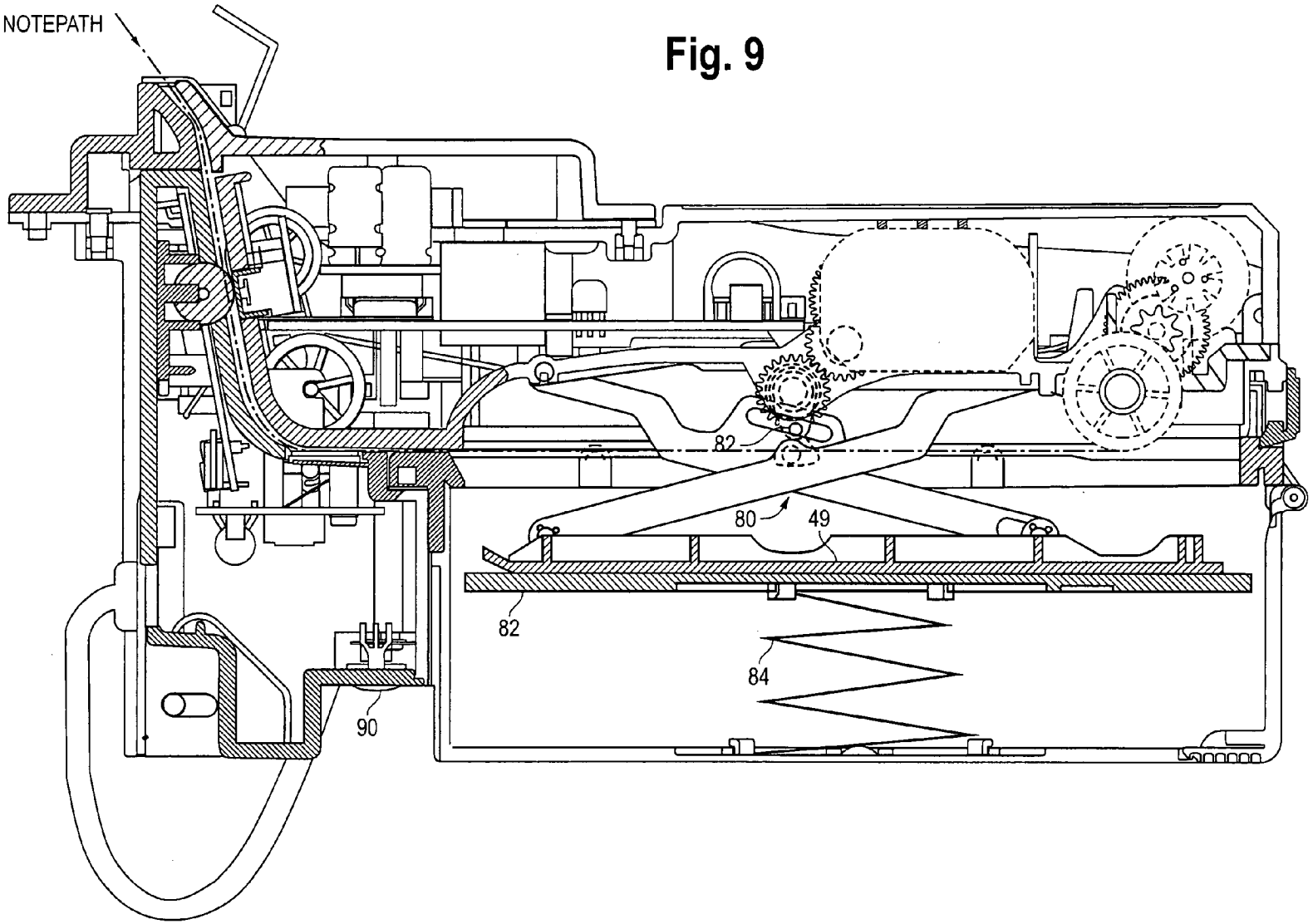
FIG. 9 depicts a document stacking mechanism that may be used by the validator of FIG. 1.

FIG. 7 shows a simplified cut-away view of a left portion of the validator 10 of FIG. 2. FIG. 8 shows a section view of the sensor section 12 of the validator 10 along lines 8—8.

Each IR/blue sensor array 52 includes an IR light emitting diode (LED) 58 and a blue LED 60 (FIG. 3). The array 52 also includes a first photodetector 62 on the same side of the document path as the IR LED 58 and blue LED 60 and located between the IR and blue LEDs 58, 60. A second photodetector 64 is located on an opposing side of the document path opposite the first photosensor 62.

A profile processing unit 108 of a control system 100 (shown in FIG. 6) of the validator 10 alternately activates the IR LED 58 to generate an IR optical signal 66 and then the blue LED 60 to generate a blue optical signal 70, each for a predetermined time period. During the time that the IR LED is activated, the processor 108 measures the IR signal detected by the first and second photodetectors 62, 64. The first photodetector 62 measures a reflected IR signal 68. The second photodetector 64 measures the transmitted signal 74 that passes through the document 46.

After measuring the IR signal, the processor 108 deactivates the IR LED 58 and activates the blue LED 60 and repeats the measurements. As above, the first photodetector 62 measures a reflected blue signal 72. The second photodetector 64 measures the attenuated signal 76 that passes through the document 46.

Similarly, the processor 108 alternately activates the super red LED and blue LED of the super red/blue array 56. The array 56 may have the same configuration and operate in substantially the same way as described with respect to FIG. 4. During the time that the super red LED is active, the processor 108 measures the reflected and transmitted super red energy on a first and second side of the document path. During the time that the blue LED is active, the processor 108 measures the reflected and transmitted blue energy on a first and second side of the document path.

As the transport system 20 moves the document 46 past the IR/blue sensor arrays 52 and the super red/blue sensor arrays 56, the processor 108 collects data 202 as described above. The processor 108 also collects data from the magnetic sensor 54. As the document moves past the arrays, a tachometer 104 measures a speed of the document past the arrays of sensors. By detecting the instant of entry of the document 46 into the validator 10 and knowing the speed of the document, the processor 102 may correlate each array and magnetic sensor reading to a position on the document. The data samples collected from each sensor may be concatenated together based upon the position on the document where it was collected to form the profile from that sensor and sensor array.

Figure 5A:
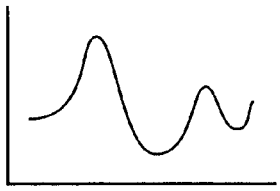
FIG. 5 depicts optical profiles provided by the arrays of FIG. 3.
Figure 5B:
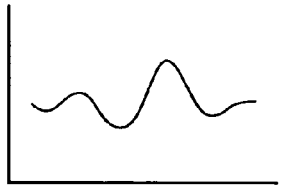
Figure 5C:
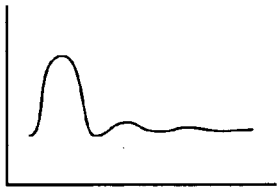
Figure 5D:
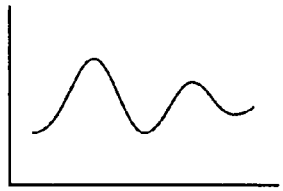

FIGS. 5*a–e* shows examples of data profiles that may be collected by the detectors 62, 64 of the IR/blue arrays 52 and super red/blue arrays 56. FIG. 5*a* shows an example of a profile of the reflected IR or super red energy measured by the detector 62 while FIG. 5*c* shows an example of a profile of the transmitted IR or super red energy measured by the detector 64. FIG. 5*b* shows an example of a profile of the reflected blue energy measured by the detector 62 and FIG. 5*d* shows an example a profile of the transmitted energy measured by the detector 64.

Figure 5E:
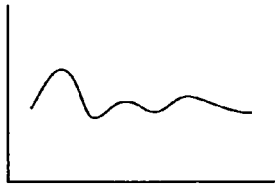

FIG. 5*e* shows an example of a difference profile that may be generated by the processor 108. The difference profile of FIG. 5*e* may be generated by subtracting the measured blue energy at each point from the IR or super red energy of an adjacent point on the document 46.

The profiles from the magnetic sensor 54, IR/blue sensor arrays 52 and super red sensor array 56 together form a set of profiles that may be used to validate the document. The set of profiles obtained from each document is compared 204 with a set of respective profile envelopes for a valid document to determine the authenticity of the document.

For example, if a number of U.S. dollar bills were to be passed through the validator, the set of profiles for each dollar bill would be very similar, but not identical. The variations among the dollar bills at identical points defines a range of valid readings at that point. The range of valid readings along the length of the dollar bill can be concatenated to form an envelope for a valid dollar bill for each sensor type. The envelopes formed by each sensor for the dollar bill together form a library document defined by a set of envelopes that can be used to validate suspect dollar bills.

In addition, a library document can be created to validate a dollar bill no matter which way it is inserted into the validator. One set of envelopes may be created with Washington's image on the upper side facing to the right and another set of envelopes may be created with Washington facing the left (i.e., the bill turned end-for-end). A third and fourth set of envelopes may be created for the dollar bill with Washington's image facing downwards and inserted into the validator first one way and then turned end-for-end.

Further, a similar set of envelopes may be created for U.S. five dollar bills, ten dollar bills, fifties and one-hundreds. Similar sets of envelopes may also be created for foreign currencies or even coupons or redemption tickets.

Included within the validator may be a library of sets 110 of envelopes for valid documents (e.g., currency). Under one embodiment, the validator may contain a library for eleven different currency types in four different directions thereby providing a library of 44 library documents, each defined by a different sets of envelopes.

Included with each set of envelopes may be a commonly-used identifier of the associated library document (e.g., a U.S. one-dollar bill, eurodollar, etc.) As the validator reads and processes each document, a processor within the validator matches the set of profiles of each suspect document with sets of envelopes of the valid library documents within memory. Matching a profile with a corresponding envelope means determining that the measured metric falls within the upper and lower limits of the envelope. Where a match is found, the suspect document may be accepted as a validated member of the set of documents identified by the commonly-used identifier (e.g., a U.S. one dollar bill).

The matching of the set of profiles of the suspect document may be accomplished under a number of different methods. Under one method, one or two pilot profiles of the set of profiles may be selected and compared with respective envelopes within the library documents to give a first estimate of the best matches. The pilot profile(s) may be selected based upon experience in providing a first good indication of identity.

Once the best matches have been identified, a more rigorous comparison may be made between the remaining profiles of the suspect document and the remaining set of envelopes of the matched library documents. By using the pilot profile as a first level of matching, the processing time for validation can be considerably reduced.

Under another embodiment, each positional value of each profile may be successively compared with corresponding positional values of the sets of envelopes of the library documents. If the values of each profile of the suspect document falls within the ranges of each envelope of the set of envelopes of one particular library document, then the match is strong evidence that the suspect document is a valid member of that particular library document.

Alternatively, a percentage value may be formed for each of the profiles of the suspect document with corresponding envelopes of the library documents. The use of percentage values may be useful in the case of defaced currency or currency with foreign materials (e.g., mending tape, ink marks, etc.) disposed on the currency.

In this case, each value at each position of a profile may be compared with the range of values of a respective position and respective envelope of the valid documents and a percentage of matching points may be calculated within the processor 102. The percentage match among the envelopes of the set of envelopes may be averaged to form an average percentage of match with each library document of the library. The library document with the greatest average percentage match to the suspect document may be selected as the set within which the suspect document most likely falls, subject to some minimum threshold value.

Alternatively, a curve matching routine may be used to match each profile of the suspect document with respective envelopes of the library documents. In this case, some mathematical or statistical formula (e.g., based upon standard deviation) may be used as evidence of a match.

As further evidence of authenticity, the UV sensor 26 may be used. In this case, it has been found that fluorescence of the document may be a counter indicator of authenticity. More to the point, prior art validators have relied upon a measurement of a level of fluorescence as an indicator of validity. The fluorescence may be provided by fluorescent inks that are used on some government-issued currencies.

However, it has been found that counterfeit documents often use paper that also provides a high level of fluorescence when subjected to UV. What has not been noted in the prior art is that valid documents fluoresce in a very narrow frequency range whereas counterfeit documents fluoresce over a relatively broad frequency range. To overcome this deficiency and provide an improvement over prior art methods, the validator described herein may use a bandpass filter 86 to suppress the fluorescence within the narrow range (in the yellow to green region) produced by valid documents. A threshold detector 106 may then by used by the processor 102 to detect fluorescence that exceeds a threshold value outside that range as a means of identifying invalid documents.

The validation of a suspect document may be based on a combination of profile processing and UV sensing. UV sensing may involve the use of an absolute threshold or a variable threshold that depends upon a position of a reading on the document or in a fluorescent profile. The final determination of authenticity may be based on a set of threshold values in the profiles processed and also upon a set of weights assigned by a weighting processor 112. For example, the threshold for at least some of the profiles processed may be set such that the profiles of the suspect document must fall within the respective envelope of the set of envelopes of a library document and be given a higher weighting factor. Alternatively, the threshold for other profiles processed may be set at some lower value to accommodate some level of defacing of the document and be given a lower weighting factor. Similarly, the UV threshold may be set at some constant level or adjusted upwards or downwards to accommodate environmental factors (e.g., sunlight entering the slot 18). In any case, once the suspect document has been found to be within the thresholds and the sum of the weights exceed some weighting threshold, the suspect document 46 may be accepted as having been validated.

Once a document has been validated, the environment of the document between arrays 52 and 56 may be examined to verify that there are no strings attached. As is known, prior art bill validators may be defeated by attaching strings to bills and using the string to pull the bill out of the validator once the bill has been accepted.

In this case, an adjustable IR transmitter 28*a* and receiver 28*b* may be used to detect the presence of tape or strings. The transmitter and receiver 28 may be arranged to operate parallel with a predominant plane of the document and to transmit the detection signal through the path 50 of the document 46. A threshold value may be used to avoid false readings due to environmental factors (e.g., sunlight). Acception or rejection may occur based upon the above criteria and upon the processor 102 detecting a signal from the receiver 28*b* (indicated that there are no strings attached) after the document 46 has reached the cassette.

Once the document 46 has been authenticated and it has been determined that no strings are attached, then the validator 10 may transmit notification of receipt and acceptance of the document using the commonly accepted terminology of the matching library document. Notification of validation may be sent by operation of the interface module 22 (discussed in more detail below). The validator 10 may also then insert (i.e., stack) the document into the cassette 16.

To determine a timing of the stacking cycle, an IR transmitter 27*a* and receiver 27*b*, located on a first side of the document path may be used in conjunction with a light pipe 25 disposed on an opposite side of the document path. The transmitter and receiver transceive an optical signal perpendicular to a predominant plane of the document 46.

The difficulty in the prior art of determining document position above the cassette 16 has been the presence of transparent windows in some foreign currencies (e.g., Australian). The transmitter 27*a* solves this problem by transmitting an optical signal through one portion of the document path 50 and the detector 27*b* detects the signal transmitted through a different portion of the document path 50. A light pipe on an opposite side of the document path transfers light from the transmitter 27*a* location laterally to the receiver 27*b* location.

Further, the light pipe is embedded in the cassette. Embedding the light pipe in the cassette allows the light pipe to also function as a detector for the presence of the cassette.

The document path of the validator is designed for documents up to 72 mm wide and approximately 160 mm long. However, many documents are much narrower than 72 mm. In order to transport documents from an entrance of the validator to the cassette, the pairs of rollers 44 and belts 38 are provided that are placed approximately 16–18 mm from the edges.

Upon insertion of a document, the pair of roller 44 initially engage and transport the document past the magnetic, IR/blue and super red/blue sensors. After the document passes the super red/blue sensor, the document engages the pair of belts 38 where it is transported past the UV sensor and to the area above the cassette and below the stacking plate 49.

As the document 46 reaches the area above the cassette, the position detector 29 sends a signal to the processor 102. The processor 102, in turn, activates the stacking motor and gear box 31 that, through the use of an drive pin 80 and scissors assembly 80 cause the stacking plate 49 to extend and retract.

By operation of the stacking motor 31 and scissors assembly 80, the stacking plate 49 pushes the document into the cassette through an aperture 86 on the upper surface of the cassette. Within the cassette, a carrier plate 82 and spring 84 function to receive the document 46 and via operation of the spring 84 cause the accumulated documents to assume a stacked format.

The stacking plate 49 occupies the area above the path 50 between the belts and is, therefore, much narrower than the document. As used herein, pushing or plunging the document into the cassette means pushing the document (perpendicular to the predominant plane of the document) through the aperture in an upper surface of the cassette where the aperture has a peripheral distance that is less than that of the document. As used herein, the predominant plane of the suspect document means that plane of the document defined by the thickness of the document or, stated differently, the predominant plane of the document lies parallel to and within the thickness of the document.

For example, the cassette may have an aperture that is approximately 160 mm long and a width of approximately 45 mm. As such, the peripheral distance of the aperture is approximately 410 mm.

In order to ensure the perpendicular translation of the predominant plane of the document from the document transport path into the cassette without lateral movement, the stacking plate may be provided with an anti-slip surface. Under one embodiment, the anti-slip surface may be obtained by disposing an area of silicone-rubber on opposing ends of the stacking plate. Under one embodiment, the area of silicon-rubber may be provided in the form of a number of silicon-rubber bumps disposed within a series of apertures (e.g., 5) proximate each end of the stacking plate. The silicon-rubber bumps may be provided by injecting the silicone-rubber into the apertures in such a way that the silicone-rubber extends above an active surface of the stacking plate by an appropriate distance (e.g., 1 mm).

Under one embodiment, the cassette has sufficient depth to accept up to 250 documents. Under other embodiments, the cassette may have sufficient depth to accept 600 or 1,000 documents.

The cassette may be provided with a pair of outwardly extending support pins on each side of the cassette. The validator may be provided with a complementary set of locking channels to accept the cassette. Locking of the cassette to the validator body may occur by lateral movement of the cassette parallel to the document path that lies immediately above the cassette.

Figure 10:
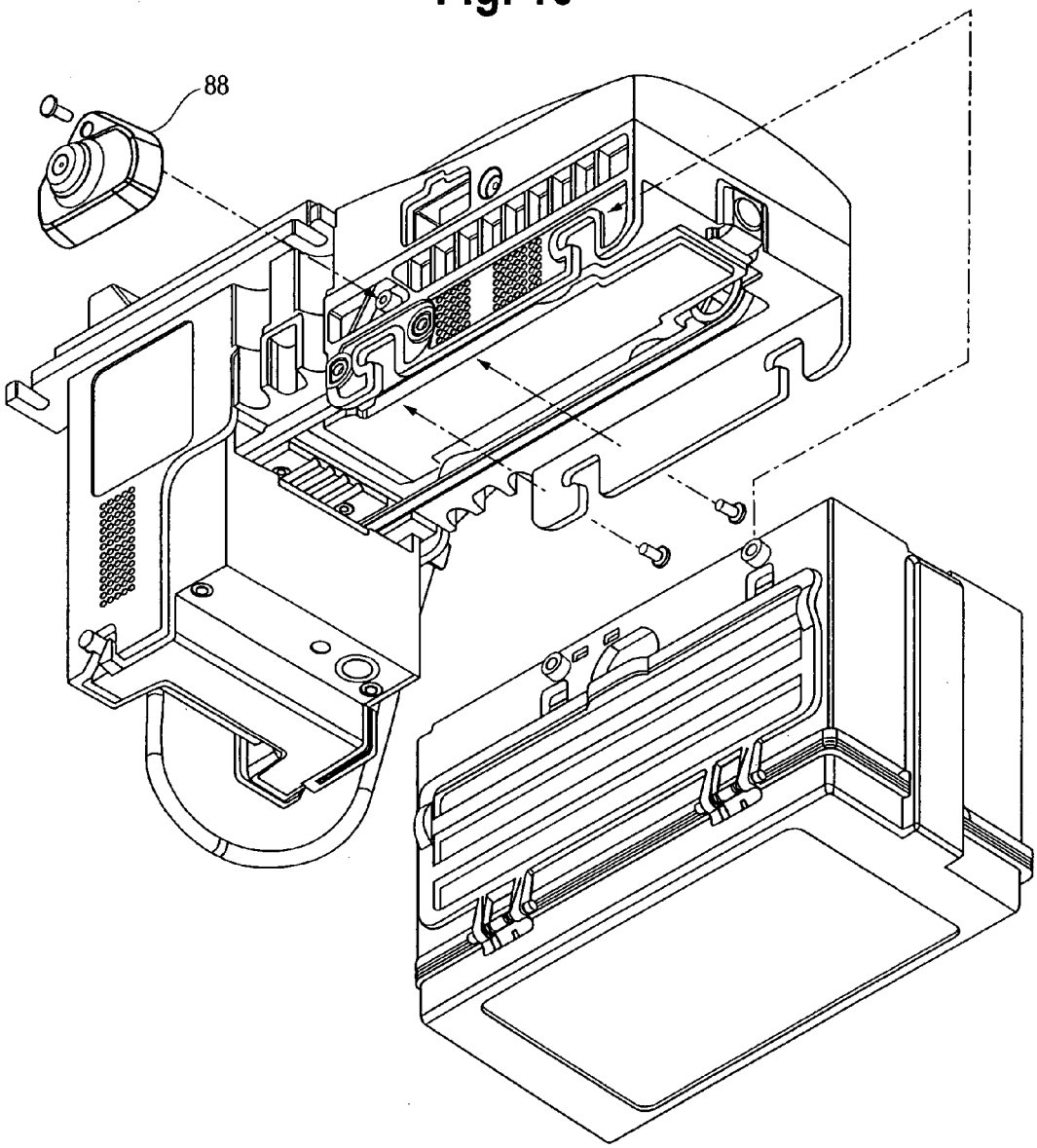
FIG. 10 depicts a locking assembly that may be used with the validator of FIG. 1.

The cassette may also be provided with an optional push lock 88 (FIG. 10) secured by a set of screws inserted from inside the validator stacking chamber to prevent removal of the cassette from the validator. The push lock may be of value in allowing a progressive level of security provided within a device relying upon the validator. For example, in vending machines, one level of personnel is allowed access to the interior of the vending machine for filling and servicing the machine while another level of personnel is allow access for emptying the cassette. Because of the trusted level of any personnel allowed within the device, the push lock does not need the mechanical strength that would be otherwise required of an external lock. More specifically, the purpose of the push lock is not to provide mechanical resistance to force, but to provide a locking mechanism that cannot be easily defeated without leaving physical evidence of tampering.

The push lock differs from the prior art in that the push lock is not related to the standard cam lock of the prior art.

In contrast, the push lock of the validator simply mounts to the validator body and is provided with an movable cylinder that may be pushed in the direction of key insertion to a locking position. The pushing of the cylinder advances a connected peg into the locking channel behind the pins of the cassette to prevent removal of the cassette from the validator.

In order to accommodate a variety of interface requirements of the environments where the validator is used, a replaceable interface module 22 (FIG. 2) may be provided for the validator. The interface module 22 may be mounted inside the validator 10 behind an easily removable face plate 24. The interface module may be used to accommodate a variety of voltages from external sources that supply power to the validator and also a variety of interface data formats that may be required by systems that rely upon the document validator. For example, the validator may be used in gaming machines (e.g., slot machines), vending machines or entry control devices (e.g., ticket validating devices for a concert or movie). In the case of a slot machine or entry control devices, a power supply voltage may be 12 volts, while for a vending machine, the supply voltage may be 24–42 volts. Further, a slot machine may require a data interface in the form of a USB connection while a vending machine may require a multi-drop bus (MDB) interface.

To accommodate the interface environment, the interface module may be provided as a printed circuit board (PCB) with a five pin receptacle on one end and a six pin receptacle on an opposing end. An opposing male portion of the five and six pin connectors may be provided on a main circuit board of the validator. The opposing male portions provide structural support for the interface module and provide a mechanism for easily replacing the module with another module adapted to accommodate a new operating environment.

Signal and power connections may be intermixed within the five and six pin connectors. Alternatively, the five pin connector may be used for supplying power to the validator while the six pin connector may be used to provide a data interface requirements. An external sixteen-pin male connector 33 may be provided on an external surface of the validator to receive power from the external source and provide data to connected devices. Predefined pins on the external connector and five and/or six pin connector may be dedicated to supplying power to the validator. Similarly, predefined pins on the external connector and five and/or six pin connector may be dedicated to the data interface format required for external devices to communicate with the validator.

In the case where the validator is to be installed in a vending machine with a 24–42 volt power supply and an MDB data exchange format, at least a first portion of the interface module would be dedicated to a power supply that would accept the 24–42 volts as an input and to reduce the 24–42 volts to a voltage useable by the validator (e.g., using a switching power supply). Similarly, a second portion of the interface module would be devoted to a set of drivers that allow the external device to communicate with the validator using the MDB format.

Alternatively, where the validator is to be installed into a local area network (LAN), then the first portion of the interface modules dedicated to supplying power to the validator may be much simpler and, in fact, may simply be a set of connecting links if the external source provides power at the same voltage as that required by the validator. The second portion of interface module, however, may be somewhat more complicated.

Alternatively, the validator may be interconnected with external devices using a USB connector. In this case, the second portion of the interface module may require a USB processor to allow the validator to register and exchange data with connected devices under the USB format. Further, an external connector in the form of a USB connector may also be needed in place of (or in addition to) the 16-pin connector.

In this case the USB processor may be programmed to accept and/or transmit formatted self-descriptive information packets or HID report descriptors as described in "The Device Class Definition for Human Interface Devices, Firmware Specification", Version 1.0—Final, USB Implementers Forum, 1997. An interpretive software module within a host computer of any connected device contains and/or uses a library of pre-defined peripheral device archtypes, data structure building rules and signal handling protocols.

The use of the USB processor allows validators 10 to be installed within other devices (e.g., slot machines) at will without the necessity of activating any software routines to install the validator 10 on the host. In this case, the validator 10 (through the USB processor and interface) automatically registers with the host upon startup and may periodically transfer status messages to the host. Further, the use of the USB interface allows a game system architect to obviate the need for a communications hub and a microcontroller to service each validator 10.

In another embodiment of the invention, the validator is provided with a reset function that avoid false resets based on careless handling of the validator when activated. In order to avoid false resets, the validator provides a time delay associated with the reset button 90. In order to activate the reset button, a user may be required to press and hold the reset button in a depressed state for a predetermined time period (e.g., 4 seconds) before a reset may be executed.

Figure 12:
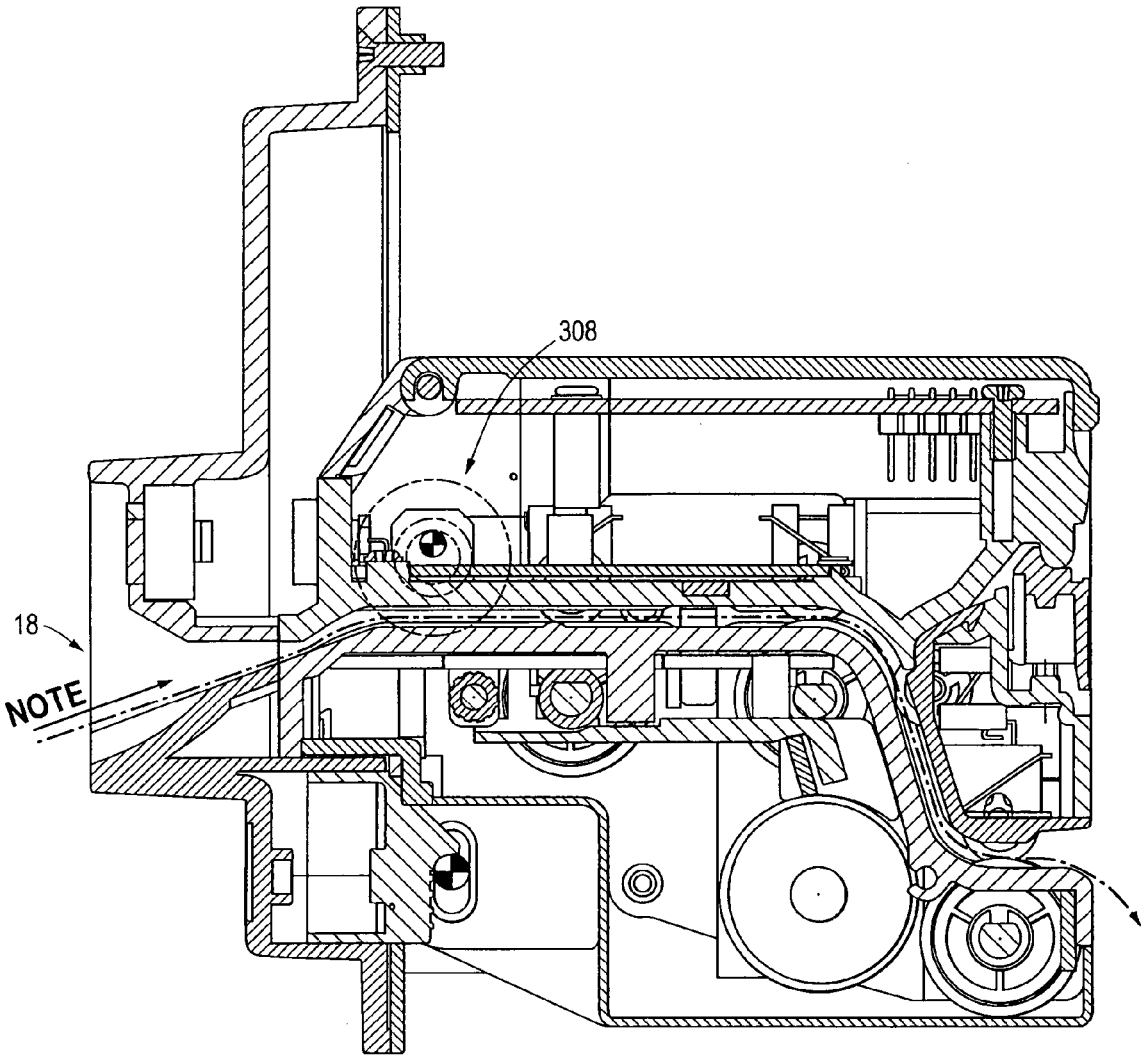
FIG. 12 depicts a cut-away view of a sensor section under an alternate illustrated embodiment that may be used with the system of FIG. 1 and that shows a set of document alignment disks.
Figure 13A:
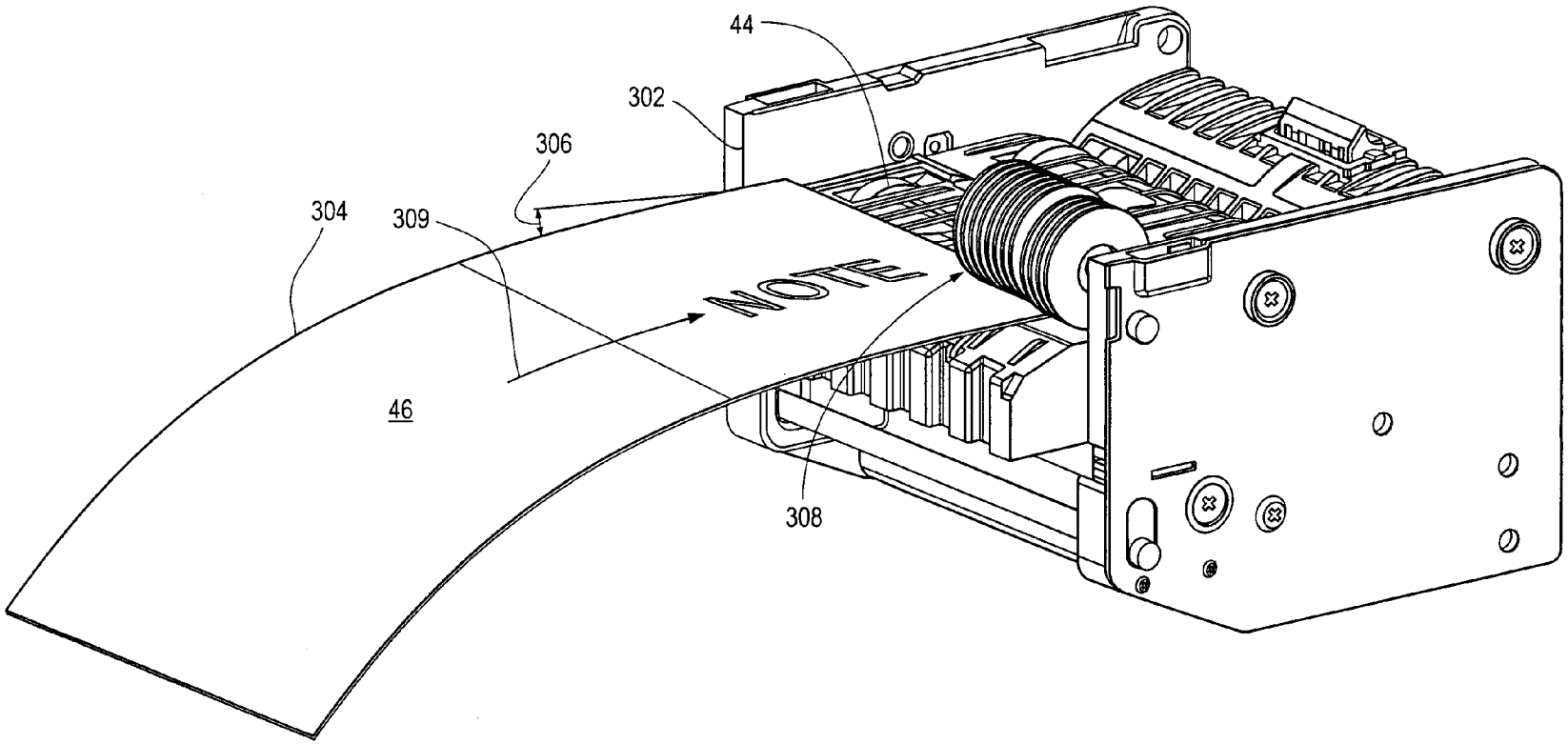
FIGS. 13*a–b* shows side and top views of the sensor section of FIG. 12.
Figure 13B:
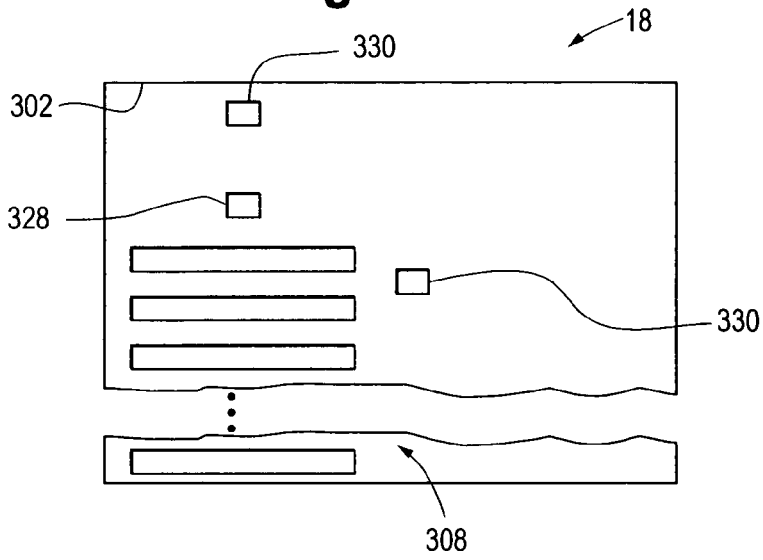

In another embodiment of the invention, one or more disks are used to mechanically align the document 46 to the document path 50 as it is inserted into the validator 10. FIGS. 12 and 13 illustrate the use of the disks in a sensor section 12 having a geometry that allows the cassette be placed behind and below the sensor section 12.

FIG. 12 is a cut-away view of the sensor section that shows a disk assembly 308 with a number of alignment disks 300. The disks 300 are located inside and adjacent the entrance slot 18 of the validator 10 and function to align a marginal edge 304 (e.g., the left edge) of the document 46 with a marginal edge 302 (e.g., the left edge) of the entrance slot 18 of the validator 10. (In this case, it will be assumed that the left marginal edge of the path of document travel 50 is defined by the left edge of the entrance slot 18.) Alignment of the edge 304 of the document 46 with the edge 302 of the entrance 18 improves the reliability of the validator 10 by ensuring that a same portion of each document 46 is profiled from document to document.

For example, if the left edge 304 of the document 46 were inserted at a slight angle 306 with respect to the left edge 302 of the entrance slot 18, then a longitudinal centerline 309 of the document 46 will not be parallel with the centerline of the path of travel 50 of the validator 10. In effect, a leading left edge of the document 46 will be closer to the left edge of the slot 18 than the trailing edge of the document 46 when it passes that same spot at the entrance 18. The result would be that the profiles would be collected along a diagonal path across the document 46.

To align the document 46 with the path 50, the disks 300 interact with the document 46 to rotate the document 46 (i.e., clockwise when viewed from above) into alignment with the path of travel 50. The disks 300 function to rotate the document using a number of different mechanisms, as discussed in more detail below.

Turning first to the disk assembly, a description of the disks 300 and their mounting hardware will be discussed first. Following a discussion of the disk assembly, a description will be provided of how the assembly interacts with the document to align the document 46 with the path 50 of the validator.

Figure 14A:
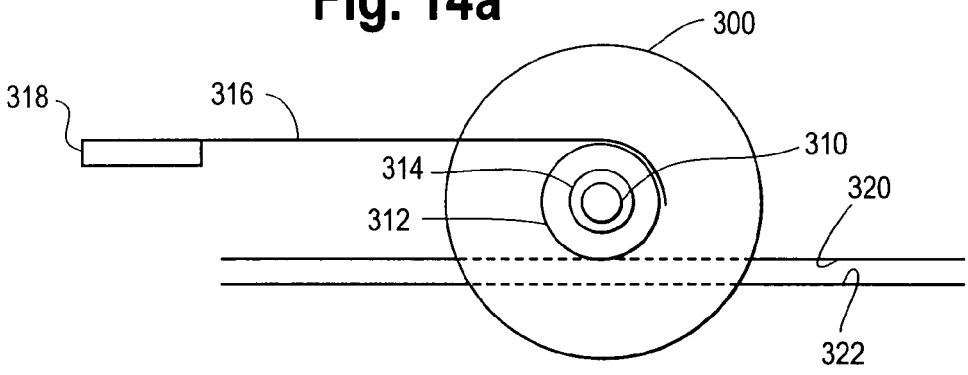
FIGS. 14*a–b* show side and top views of a disk assembly that may be used with the sensor section of FIGS. 13*a–b*.
Figure 14B:
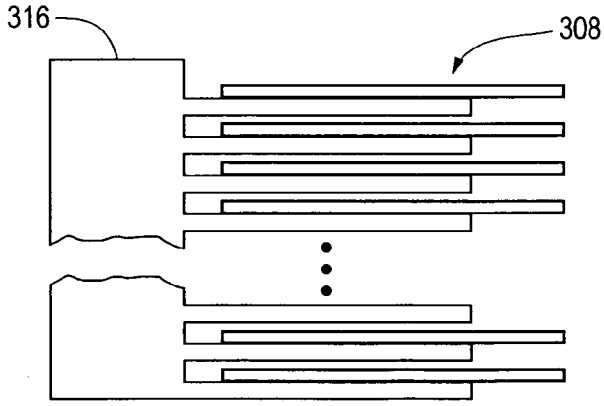

FIGS. 14*a–b* show side and top views of the disk assembly 308 respectively. The disk assembly 308 may include a number of disks 300, a spring assembly 316 and support element 318. Each of the disks 300 may have an overall diameter of about 19.5 mm.

Also shown in FIG. 14*a* are upper surface 320 and lower surface 322 that define the document path 50 in between. As shown, the disks 300 may extend through slots within the upper surface 320 and through slots in the lower surface 322 by about 1.25 to 1.5 mm to increase the lateral force that is imparted to a misaligned document 46 and to move a point of interaction with the document 46 closer to the entrance for reasons discussed below.

As shown in FIG. 14*a*, the disks 300 are loosely supported by a common shaft 310. The common shaft 310 may have a diameter of approximately 3 mm while a center hole 312 of each of the disks 300 may have a diameter of about 6.5 mm. As used herein, loosely supported means that the hole 312 is about twice as large as the supporting shaft 310. The loose support of the disks 300 by the shaft 310 allows the disks 300 to float up and down based upon the interaction of the document 46 with the spring assembly 316.

Surrounding the center hole 312 on one side of each disk 300 is an annular collar 314 that that is integral with each disk 300. The collar 314 extends outwards from the disk in a direction that is transverse to the disk and parallel to a longitudinal axis of the support shaft 310 by about 1.4 mm. The disks 300 may have an overall thickness (including collar 314) of about 3 mm.

Figure 15A:
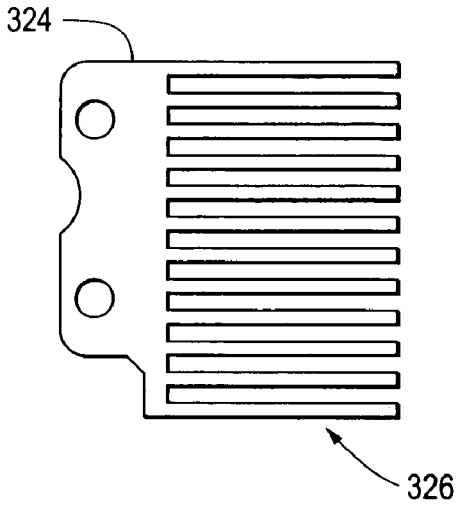
FIGS. 15*a–c* depict top, side and perspective views of a spring assembly used of FIGS. 14*a–c*.
Figure 15B:
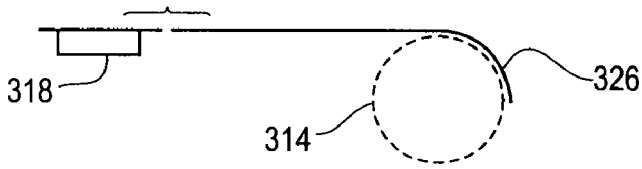
Figure 15C:
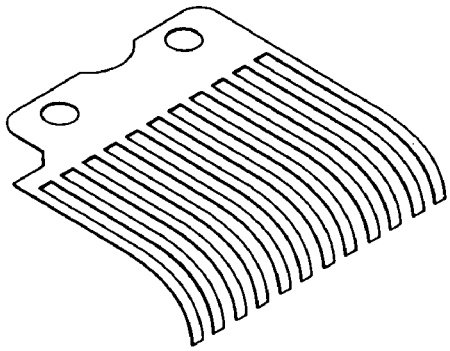

FIGS. 15*a–c* shows top, side and perspective views of the spring assembly 316. As shown by the top view in FIG. 15*a*, the spring assembly 316 has a comb-like shape that includes a base 324 and a number of teeth 326. The teeth 326 may have a nominal thickness of about 0.1 mm and a width of about 0.9 mm.

Each of the teeth 326 engage a top surface of a collar 314 to urge the corresponding disk 300 into the document path 50. A hook on a far end of each tooth 326 defines a limit of forward travel of the disks 300. A straight surface behind the hook allows the disk 300 to move towards the base 324 as the disk 300 interacts with the document 46.

FIG. 15*b* shows the distance from the spring support 318 to the collar 314 as having a distance of about 17.3 mm. The diameter of the collar 314 is about 9 mm. The loose support of the disks 300 by the shaft 310 and engagement of each disk 300 by only a single tooth 326 allows each disk 300 to move independently of all of the other disks 300.

In operation, a pair of preliminary sensors 328, 330 (FIG. 13*b*) detect insertion of a document 46 into the validator 10. Both preliminary sensor 328, 330 may lie along a transverse line centered on the disks 300. A first preliminary sensor 328 of the pair of sensors may be disposed proximate the left edge 302 of the entrance slot 18. The second sensor 330 may lie near the disks 300.

In use, both preliminary sensors 328, 330 must be activated to initiate document validation. If the sensor 330 proximate the disks is activated, the drive capstans 44 will be activated in a reverse direction. In this case, activation of the sensor 330 (nearest the disks 300) would indicate a document so seriously misaligned as to require re-insertion.

If both preliminary sensors are activated, then the drive capstans 44 are activated to pull the document 46 into the validator 10. As the document 46 is pulled into the validator 10, one or more of the disks 300 would interact with a marginal edge of the document 46. (As used herein, the term "marginal edge" refers to the side of the document, it does not mean the leading or trailing edge of the document 46.) As the marginal edge of the document 46 begins to interact with the first disk 300 (closest the center of the path of travel 50), the point of interaction between the document 46 and disk 300 is along a leading edge of the disk 300 forward of the support shaft 310. The point of interaction is ahead of the shaft 310 because, as shown in FIG. 14*a*, the marginal edges of the disks 300 initially extend across the path of travel 50 of the document 46. Since the point of interaction is ahead of the shaft 310, as the disk 300 begins to rotate on the shaft 310, the disk 300 is pushed backwards. However, pushing the disk 300 backwards shortens the effective length of the spring tooth 326 causing a nonlinear increase in the downward force of the tooth 326 against the disk 300. Because of the increased downward force, as the disk 300 rotates, it also slides along an outside marginal edge of the document 46 laterally pushing the document into alignment. As the disk 300 begins to ride up over the marginal edge of the document, it forces the document downwards against the lower surface 322 of the path 50 thereby increasing the frictional resistance to forward movement of that side of the document 46. The net effect is a lateral, rotational-inducing force exerted on the document forcing the trailing edge of the document 46 towards the opposite edge 302 of the path of travel.

Resisting the rotational force on the document 46 provided by the disks 300 in the reverse direction is the forward (frictional) force provided by the capstan 44 lying directly behind the disks 300. If the forward frictional force provided by the capstan 44 is greater than the rotational force on the document 46 provided by the first disk 300, then the first disk 300 will eventually be forced upwards and the document 46 will begin interacting with the second disk 300 from the center. The process may be repeated until enough disks 300 interact with the document 46 to overcome the frictional force provided by the capstan 44 behind the disks 300. Once the frictional force of the capstan 44 is overcome, the document 46 will begin to rotate into alignment with the edge 302 of the path of travel 50. As the document 46 rotates, fewer and fewer disks 300 will interact with the document 46. However, since sliding frictional forces are always greater than static frictional forces, the capstan 44 behind the disks 300 will not regain a static frictional grip on the document 46 until the document has been substantially aligned with the document path 50.

In addition to aligning the document with the left edge 302, the disk assembly 308 also functions to resist spontaneous misalignment caused by a loss of static friction by the capstan 44 along the left edge 302. In this case, a loss of static friction may be caused by any of a number of natural or man-made sources (e.g., oil on the document, mending tape, etc.). In this case, a loss of forward motion along the left edge would cause the right edge to rotate and impinge on the disks 300. In this case, the interaction of the disks 300 with the right edge would also now cause a retarding force on the right side tending to resist any further misalignment and to, in fact, re-establish a previous alignment with the left edge 302.

A specific embodiment of a document validator has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. An apparatus for processing a document traveling along a document path within a document validator, such apparatus comprising:

a disk where a periphery of the disk extends into the document path of the document validator;

a support shaft that passes through a center hole of the disk, the shaft loosely supporting the disk and allowing the disk to rotate around the shaft in a predominant plane of the disk and to freely move in the predominant plane of the disk in a direction that is perpendicular to a longitudinal axis of the shaft; and a resilient member that biases the disk into the document path to engage a side edge of the document when the document is misaligned with the document path as it travels along the document path thereby retarding forward movement of the side edge and rotation of the document into alignment with the document path.

2. The apparatus for processing a document as in claim 1 further comprising defining a diameter of the center hole of the disk as being at least twice as large as a diameter of the support shaft.

3. The apparatus for processing a document as in claim 1 further comprising the periphery of the disk extending through the document path in the absence of the document.

4. The apparatus for processing a document as in claim 1 wherein the disk further comprises a collar disposed around the center hole of the disk.

5. The apparatus for processing a document as in claim 4 wherein the resilient member further comprises a leaf spring that engages the collar on a first end and that extends rearward of the disk along the document path to a support member.

6. The apparatus for processing a document as in claim 5 wherein the disk further comprises a plurality of disks and a plurality of leaf springs where each leaf spring of the plurality of leaf springs engages a collar of a respective disk of the plurality of disks.

7. The apparatus for processing a document as in claim 6 wherein the plurality of leaf springs further comprises a spring assembly.

8. The apparatus for processing a document as in claim 7 wherein the spring assembly further comprises a comb shape.

9. The apparatus for processing a document as in claim 8 wherein each leaf spring of the spring assembly further comprises a hook on an engagement end of the leaf spring to limit a forward travel of a corresponding disk.

10. The apparatus for processing a document as in claim 9 wherein each spring of the spring assembly further comprises a straight portion between the hook and base member that allows a corresponding disk to move rearward towards the support member of the spring assembly as the disk interacts with the document resulting in a nonlinear downward force on the disk due to a shortened effective length of the leaf spring.

11. An apparatus for processing a document traveling along a document path in a document validator, such apparatus comprising:

a disk where a periphery of the disk extends into the document path of the document validator;

a support shaft that extends through a center hold of the disk, that loosely supports the disk and that allows the disk to freely move in a direction that is perpendicular to a longitudinal axis of the shaft; and a resilient member that biases the disk into the document path and applies a nonlinear force against the disk based upon a displacement of the disk in a direction of travel of the document.

12. The apparatus for processing a document as in claim 11 wherein the disk extends through the document path to engage a side edge of the document when the document is misaligned with the document path as it travels along the document path thereby retarding forward movement of the side edge and rotation of the document into alignment with the document path.

13. The apparatus for processing a document as in claim 11 wherein loosely supported further comprises defining a diameter of the center hole of the disk as being at least twice as large as a diameter of the support shaft.

14. The apparatus for processing a document as in claim 11 wherein the disk further comprises a collar disposed around the center hole of the disk.

15. The apparatus for processing a document as in claim 14 wherein the resilient member further comprises a leaf spring that engages the collar on a first end and that extends rearward of the disk along the document path to a support member.

16. The apparatus for processing a document as in claim 15 wherein the disk further comprises a plurality of disks and a plurality of leaf springs where each leaf spring of the plurality of leaf springs engages a respective disk of the plurality of disks.

17. The apparatus for processing a document as in claim 16 wherein the plurality of leaf springs further comprises a spring assembly.

18. The apparatus for processing a document as in claim 17 wherein the spring assembly further comprises a comb shape.

19. The apparatus for processing a document as in claim 18 wherein each leaf spring of the spring assembly further comprises a hook on an engagement end of the leaf spring to limit a forward travel of a corresponding disk.

20. The apparatus for processing a document as in claim 19 wherein each spring of the spring assembly further comprises a straight portion between the hook and base member that allows a corresponding disk to move rearward towards the support member of the spring assembly as the disk interacts with the document resulting in a nonlinear downward force on the disk due to a shortened effective length of the leaf spring.

21. An apparatus for aligning a document with a document path in a document validator, such apparatus comprising:

a plurality of disks where a periphery of each disk of the plurality of disks extends into the document path of the document validator, said disks each having a center hole;

a support shaft that loosely supports the disks, said support shaft having a diameter that is approximately one-half the diameter of the center hole of the disks; and a resilient member that biases the disks into the document path.

* * * * *